US006830036B2

(12) United States Patent
Okajima et al.

(10) Patent No.: US 6,830,036 B2
(45) Date of Patent: Dec. 14, 2004

(54) FUEL SUPPLY APPARATUS HAVING RESILIENT INJECTOR-PRESSING MEMBER

(75) Inventors: Masahiro Okajima, Kariya (JP); Hitoshi Shibata, Okazaki (JP); Yoshitomo Oguma, Hekinan (JP); Shinji Sugiura, Anjo (JP); Kazuo Yamamoto, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/625,849

(22) Filed: Jul. 24, 2003

(65) Prior Publication Data

US 2004/0194764 A1 Oct. 7, 2004

(30) Foreign Application Priority Data

| | | |
|---|---|---|
| Jul. 26, 2002 | (JP) | 2002-218050 |
| Nov. 15, 2002 | (JP) | 2002-332450 |
| Apr. 28, 2003 | (JP) | 2003-123621 |

(51) Int. Cl.[7] ..... F02M 55/02
(52) U.S. Cl. ..... 123/470
(58) Field of Search ..... 123/470, 468, 123/469, 509

(56) References Cited

U.S. PATENT DOCUMENTS

| | | | | |
|---|---|---|---|---|
| 6,338,333 | B1 * | 1/2002 | Brosseau et al. | 123/456 |
| 6,431,151 | B1 | 8/2002 | Gmelin | |
| 6,481,421 | B1 * | 11/2002 | Reiter | 123/470 |
| 6,772,736 | B2 * | 8/2004 | Liskow | 123/470 |

FOREIGN PATENT DOCUMENTS

| | | |
|---|---|---|
| EP | 1 134 406 A2 | 9/2001 |
| JP | 11-287168 | 10/1999 |

* cited by examiner

*Primary Examiner*—Bibhu Mohanty
(74) *Attorney, Agent, or Firm*—Nixon & Vanderhye P.C.

(57) ABSTRACT

A fuel transfer pipe and a cylinder head of an engine in which a fuel injection device is restricted from being separated from each other by a restricting member. A pressing member is interposed between the fuel transfer pipe and the cylinder head to receive a restricting force of the restricting member presses the fuel transfer pipe to a side opposing the cylinder head and presses the fuel injection device to a side of the cylinder head by a reaction force against the restricting force.

27 Claims, 10 Drawing Sheets

FUEL SUPPLY APPARATUS HAVING RESILIENT INJECTOR-PRESSING MEMBER

CROSS REFERENCE TO RELATED APPLICATION

This application is related to and incorporates herein by reference Japanese Patent Applications No. 2002-218050 filed on Jul. 26, 2002, No. 2002-332450 filed on Nov. 15, 2002 and No. 2003-123621 filed on Apr. 28, 2003.

FIELD OF THE INVENTION

The present invention relates to a fuel supply apparatus, which resiliently presses a fuel injector to the cylinder head of an internal combustion engine.

BACKGROUND OF THE INVENTION

Various fuel supply apparatuses are provided for injecting fuel transferred by a fuel transfer pipe into a cylinder of an internal combustion engine by a fuel injection device (injector). In some fuel supply apparatuses, one end of the injector on a side of a fuel injection port and the other end thereof on a side of a fuel flow inlet are respectively inserted in to a cylinder head and the fuel transfer pipe of the engine.

For example, according to an apparatus disclosed in JP-A-11-287168, a pressing member comprising a leaf spring is fixed to a cylinder head along with a stay provided at a fuel transfer pipe and an injector is pressed to a cylinder head by the pressing member.

According to this apparatus, between the fuel transfer pipe and the cylinder head, the pressing member is fixed to the cylinder head by a bolt. Therefore, when a fuel supply apparatus is integrated to inside of a V-bank of the cylinder head as shown, a space cannot sufficiently be ensured at a surrounding of a bolt fixing portion. In this case, it is difficult to fasten the bolt. Therefore, cost required for integration is increased and the magnitude of the axial force of the bolt cannot be achieved as expected. Particularly, since a press force for pressing the injector is obtained by resiliently deforming the pressing member comprising the leaf spring by the axial force of the bolt, a reduction in the axial force leads to a reduction in the pressing force. In the case of the leaf spring having a short free length, the spring constant must be set to be large in order to ensure the press force. Therefore, the press force is considerably reduced even by a slight reduction in the axial force.

Further, according to another apparatus shown in FIG. 16, a cylinder head 100 is fixed with a clamp member 102 and an injector 104 is pressed to the cylinder head 100 by the clamp member 102.

According to this apparatus, a middle portion 102*b* of the clamp member 102 is fixed to the cylinder head 100 by a bolt in a state of bringing one end 102*a* of the clamp member 102 into contact with the cylinder head 100 and the other end 102*c* of the clamp member 102 is engaged with an injector 104. Thereby, a lever comprising the one end 102*a*, the middle portion 102*b* and the other end 102*c* of the clamp member 102 respectively functions as a fulcrum. The injector 104 is pressed by the end 102*c* of the clamp member 102. The clamp member 102 utilized as the lever in this way needs to be highly rigid and therefore, the clamp member 102 becomes expensive.

Further, in order to fix the injector 104 to be durable against high combustion pressure in the engine, the distance between the end 102*a* and the middle portion 102*b* of the clamp member 102 needs to be long based on a lever ratio. Therefore, a large space needs to be ensured for arranging the clamp member 102 to deviate from a center axis of the injector 104 to one side in a diametric direction and depending on a shape of the cylinder head 100, arranging the clamp member 102 may become difficult.

SUMMARY OF THE INVENTION

It is an object of the invention to provide a fuel supply apparatus reducing cost required for integrating to a cylinder head of an engine.

It is another object of the invention to provide a fuel supply apparatus capable of easily and solidly integrating to a cylinder head of an engine.

It is a further object of the invention to provide an integrating part preferable for easily and solidly integrating a fuel supply apparatus to a cylinder head of an engine.

It is a still further object of the invention to provide a fuel supply apparatus requiring a small space for integrating to a cylinder head of an engine.

According to the first aspect of the present invention, a fuel supply apparatus has a fuel injection device, a fuel transfer pipe, a restricting member for restricting the fuel transfer pipe and a cylinder head from being separated from each other, and a pressing member interposed between the fuel transfer pipe and the fuel injection device. The pressing member receives a restricting force of the restricting member for pressing the fuel transfer pipe to a side opposing the cylinder head and pressing the fuel injection device to a side of the cylinder head by a reaction force against the restricting force.

According to the second aspect of the present invention, a fuel supply apparatus has a fuel injection device and a resilient integrating member for integrating the fuel injection device to a cylinder head. The integrating member includes a first pressing portion and a second pressing portion. The first pressing portion is fixed to the cylinder head for pressing the second pressing portion by being deformed resiliently. The second pressing portion is arranged between an insertion portion of the fuel injection device inserted in the insertion port and the insertion portion for pressing a projection projected from the insertion portion to an outer side in a diametric direction to a depth side of the insertion port by receiving a pressing force of the first pressing portion.

According to the third aspect of the present invention, a fuel supply apparatus has a fuel injection device and a resilient integrating member for integrating the fuel injection device to a cylinder head. The cylinder head has an insertion port as a locking portion by an inner wall thereof. The integrating member is locked by the locking portion to receive a reaction force and presses the fuel injection device to a depth side of the insertion port by the reaction force.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS (First Embodiment)

Figure 1:
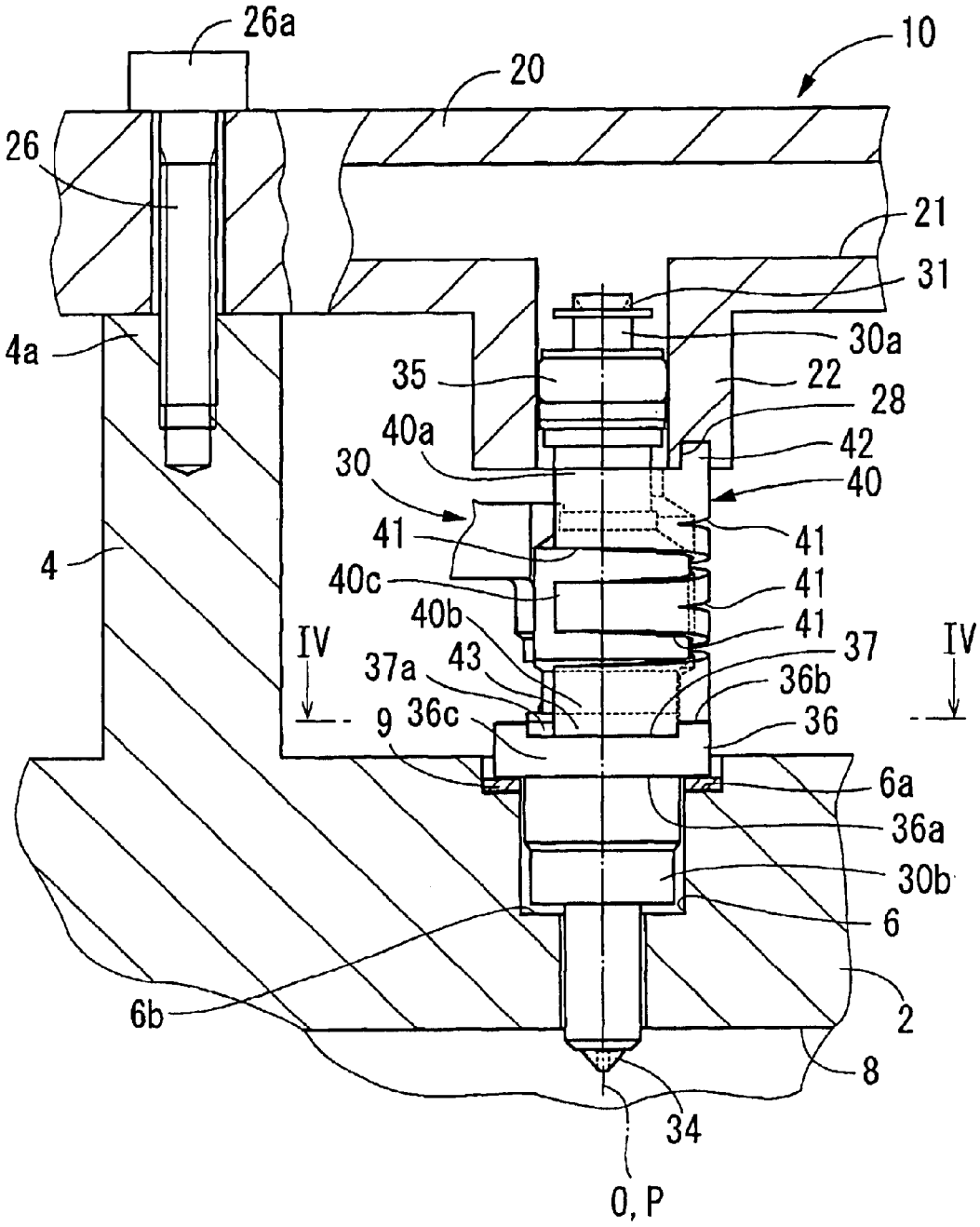
FIG. 1 is a partial sectional view showing a fuel supply apparatus according to a first embodiment of the present invention.
Figure 2:
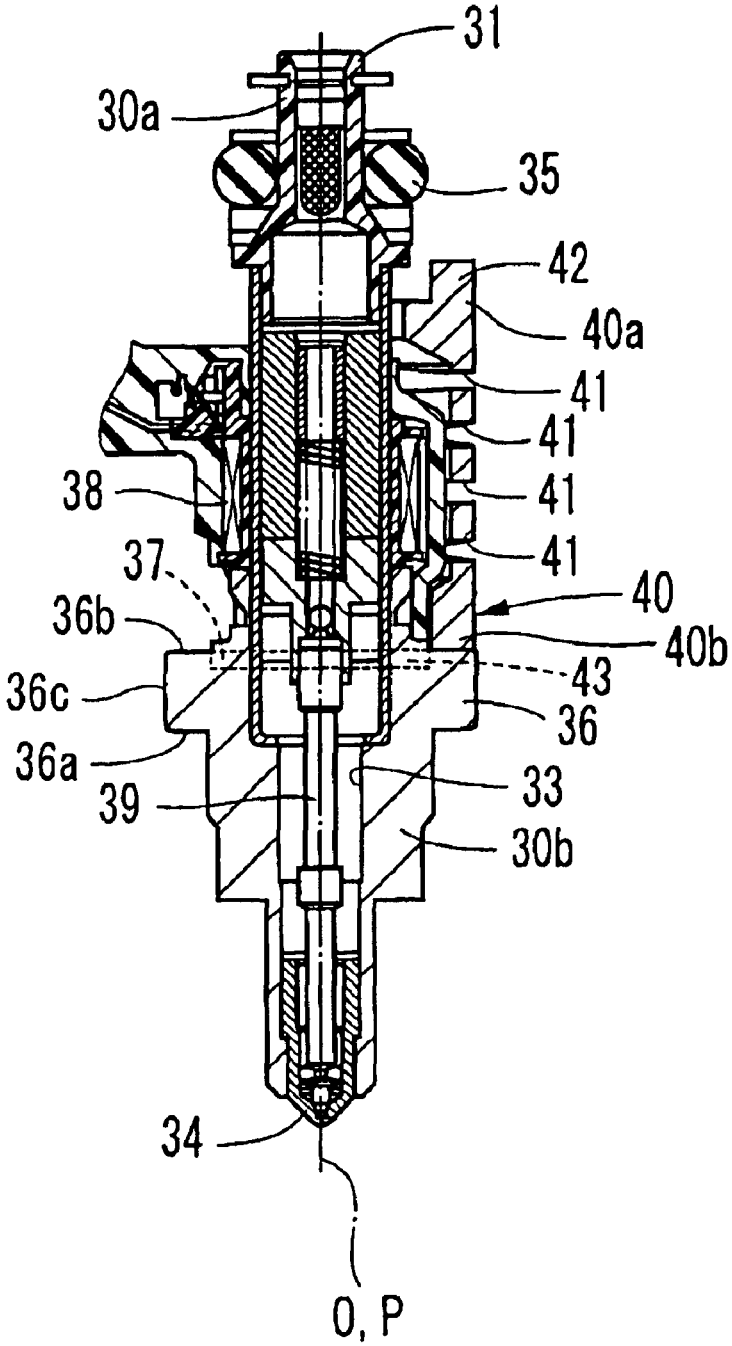
FIG. 2 is a sectional view showing an injector and a pressing member of the fuel supply apparatus shown in FIG. 1.

Referring first to FIG. 1 and FIG. 2, a fuel supply apparatus 10 is integrated to a cylinder head 2 of an internal combustion engine. The fuel supply apparatus 10 is provided with a fuel transfer pipe 20, a fuel injector 30 and a pressing member 40, which presses the injector 30.

The fuel transfer pipe 20 forms a transfer path 21 for transferring fuel. The fuel transfer pipe 20 includes a fuel supply port 22 for supplying fuel to the injector 30. The fuel supply port 22 is formed in a cylindrical shape projecting to an outer peripheral side of the fuel transfer pipe 20 to communicate an inner hole thereof to the transfer path 21. The cylinder head 2 is integrally formed with a support member 4 extending to a side of the fuel transfer pipe 20 and an extended side end 4*a* of the support member 4 is fastened with the fuel transfer pipe 20 by a bolt 26. By the fastening, the fuel transfer pipe 20 and the cylinder head 2 are fixed to be unable to displace relative to each other to be restricted from being separated from each other, and the restricting force thereof is exerted between the elements 20 and 2. A head 26*a* of the bolt 26 can be operated from a side of the fuel transfer pipe 20 opposing to the cylinder head 2. According to the embodiment, the support member 4 and the bolt 26, which is a screwed, operate as a restricting device. Further, the support member 4 formed separately from the cylinder head 2 may be fixed to the cylinder head 2.

One axial end 30*a* of the injector 30 is provided with a fuel flow inlet 31. The end 30*a* on a side of the fuel flow inlet is inserted into the fuel supply port 22 coaxially, movable to both sides in the axial direction and rotatable around the center axis O. An inner hole of the fuel flow inlet port 31 communicates with the inner hole of the fuel supply port 22 in a state in which the end 30*a* on the side of the fuel flow inlet is inserted into the fuel supply port 22 and fuel inside the fuel transfer pipe 20 flows into a fuel path 33 inside injector 30 via the fuel supply port 22 and the fuel flow inlet 31. An interval between the end 30*a* on the side of the fuel inlet port and the fuel supply port 22 is sealed by an O-ring 35.

The other axial end 30*b* of the injector 30 is provided with a fuel injection port 34. The end 30*b* on the side of the fuel injection port 34 is inserted into an insertion port 6 of the cylinder head 2. A cross-sectional face of the insertion port 6 is circular and a diameter thereof is stepped in two stages from a side of an opening portion thereof toward a depth portion thereof connected to a cylinder 8 of the engine. The end 30*b* on the side of the fuel injection port 34 is provided with a flange 36 as a projecting portion upstream from the fuel injection port 34. The flange 36 is formed in a shape of a circular ring plate projecting from a main body of the end 30*b* on the side of the fuel injection port 34 to an outer side in the diametric direction. The end face 36*a* of the flange 36 on the downstream side is brought into contact, via a gasket 9, with a stepped face 6*a* in two stepped faces 6*a* and 6*b* in a circular ring shape of the insertion port 6. The gasket 9 seals an interval between the end 30*b* on the side of the fuel injection port 34 and the insertion port 6. The fuel injection port 34 progresses into the cylinder 8 in a state in which the flange 36 is brought into contact with the stepped face 6*a*.

In the injector 30 of an electric drive type, a valve member 39 reciprocates in the body in an axial direction by a magnetic circuit formed by a coil 38 in accordance with current supplied from a connector, not illustrated, to open and close the inner hole of the fuel injection port 34 by the valve member 39. When the inner hole of the fuel injection port 34 is opened, the injector 30 injects fuel inside the fuel path 33 to the cylinder 8. Further, in the injector 30, the flange 36 is formed by a magnetic material to prevent the magnetic circuit from being formed.

Figure 3:
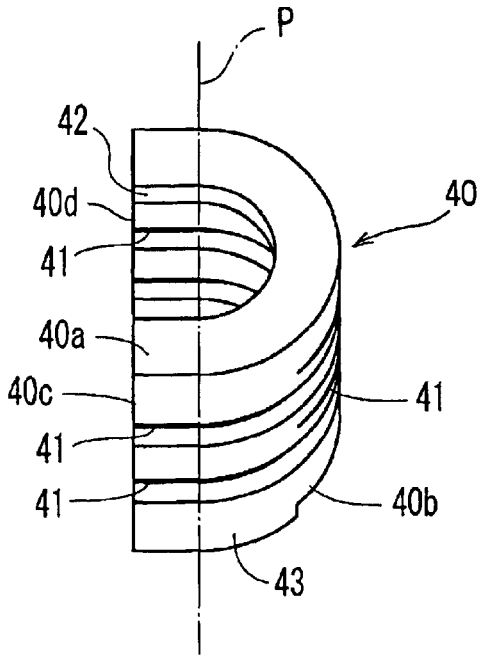
FIG. 3 is a perspective view showing an integrating part used as the pressing member of the fuel supply apparatus shown in FIG. 1.

The pressing member 40 is constituted by an integrating part shown in FIG. 3. The pressing member 40 is formed resiliently deformably by, for example, tool material of carbon steel (SK material) or the like and is supported on an outer peripheral side of the injector 30 coaxially as shown in FIG. 1 and FIG. 2. Specifically, the pressing member 40 is provided with a cross-sectional face in a U-like shape extending on the outer peripheral side of the injector 30 in a peripheral direction by a length of a half periphery or more. The pressing member 40 is formed with a plurality of notches 41 aligned in the axial direction of the injector 30. Each notch 41 penetrates the pressing member 40 in the diametric direction and extended from an end edge 40*c* or 40*d* on one side in the peripheral direction by a length which does not reach the end edge 40*d* or 40*c* on other side. The notches 41 contiguous to each other in the axial direction are formed to start to be extended from the end edges 40*c* and 40*d* different from each other. By the plurality of notches 41, the pressing member 40 has a reduced rigidity in the axial direction and is facilitated to deform resiliently in the axial direction. That is, the notch 41 promotes resilient deformation by reducing an coefficient of resiliency of the pressing member 40. According to the embodiment, in integrating the fuel supply apparatus 10, mentioned later, spring force is set such that resilient reaction force of the resiliently deformed pressing member 40 becomes equal to or larger than 200N. In this way, the pressing member 40 as a whole forms a resilient portion.

One axial end 40*a* of the pressing member 40 in the axial direction is provided with a first projection 42. The first projection 42 is projected in the axial direction from the end 40*a* of the pressing member 40 and is fitted to a first recess 28 opening at a projected front end face of the fuel supply port 22. Meanwhile, the other axial end 40*b* of the pressing member 40 in the axial direction is provided with two second projections 43. The two second projections 43 are both projected from the end 40*b* of the pressing member 40 in the axial direction and respectively fitted to two second recesses 37 opening at an upstream side end face 36*b* and a side face 36*c* of the flange 36 in the injector 30.

Figure 4:
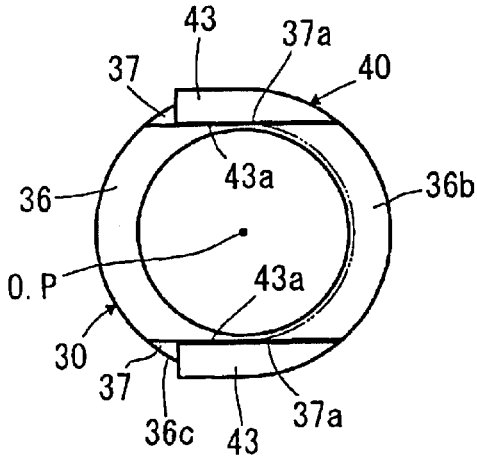
FIG. 4 is a sectional view taken along a line IV—IV of FIG. 1.

As shown in FIG. 4, two inner wall faces 37*a* facing each other in parallel are formed at openings of the respective second recess 37 on sides of the side faces 36*c* in a shape of a flat face. A diameter from the center axis O of the injector 30 to each point on the inner wall face 37*a* is changed in the peripheral direction and the inner wall face 37*a* constitutes a changing portion. Inner peripheral faces 43*a* of the respective second projections 43 are formed in a shape of a flat face and substantially whole faces thereof are brought into contact with the corresponding inner wall faces 37*a* of the second recesses 37.

Further, according to the embodiment, the inner wall faces 37*a* of the two second recesses 37 are formed to constitute a mode of two face widths in parallel with each other interposing the center axis O of the injector 30 and the inner peripheral faces 43*a* of the two second projections 43 are formed in parallel with each other interposing a center axis P of the pressing member 40.

The fuel supply apparatus 10 is integrated to the cylinder head 2 in the following processes.

(1) The integrating part of FIG. 3 is arranged on the outer peripheral side of the injector 30 as the pressing member 40 and the second projection 43 of the pressing member 40 is fitted to the second recess 37 of the flange 36.

(2) The end 30*a* of the injector 30 on the side of the fuel flow inlet is inserted to the fuel supply port 22 and the first projection 42 of the pressing member 40 is fitted to the first recess 28 of the fuel supply port 22. Thereby, the pressing member 40 is interposed between the fuel supply port 22 and the flange 36 to position.

(3) The end 30*b* of the injector 30 on the side of the fuel injection port is inserted into the insertion port 6 of the cylinder head 2.

(4) The fuel transfer pipe 20 is fastened to the support member 4 by the bolt 26 to be fixed to the cylinder head 2. Thereby, the restricting force operated between the fuel transfer pipe 20 and the cylinder head 2 is transmitted to the pressing member 40 interposed between the fuel supply port 22 and the flange 36. The pressing member 40, which receives the transmitted force, is compressed to resiliently deform in the axial direction and exerts resilient reaction force against the transmitted force to the fuel supply port 22 and the flange 36 on both sides in the axial direction. By pressing the fuel transfer pipe 20 to a side opposite to the cylinder head 2 by the resilient reaction force, the pressing member 40 is fixed to the fuel transfer pipe 20. Further, by pressing the flange 36 of the injector 30 to the side of the cylinder head 2 by the resilient reaction force, the pressing member 40 fixes the injector 30 to the cylinder head 2.

In the above fuel supply apparatus 10, the head 26*a* of the bolt 26 can be operated from the side of the fuel transfer pipe 20 opposing the cylinder head 2. Therefore, even when the apparatus 10 is integrated to the cylinder head 2, the screw fastening operation in the process (4) is facilitated. Thereby, the restricting force between the fuel transfer pipe 20 and the cylinder head 2 can surely be exerted. Therefore, the resilient reaction force of the pressing member 40 against the restricting force, that is, the pressing force of the fuel transfer pipe 20 and the injector 30 by the pressing member 40 can sufficiently be ensured.

Further, the pressing member 40 of the fuel supply apparatus 10 is pinched by the fuel supply port 22 and the flange 36 at the injector end 30*b* and is resiliently deformed in the axial direction which is the pinching direction. Therefore, the resilient reaction force for pressing the fuel transfer pipe 20 and the injector 30 can surely be exerted. Further, the coefficient of resiliency of the pressing member 40 is reduced by the plurality of notches 41. Therefore, the amount of changing the resilient reaction force relative to a change in the restricting force can be reduced. Simultaneously not only the resilient reaction force but also the pressing force can be increased by increasing the resilient deformation amount.

Furthermore, the pressing member 40 is constituted by the shape surrounding a region of the outer peripheral side region of the injector 30 less than entire periphery in the peripheral direction. Therefore, in the process (1), the pressing member 40 can easily be arranged on the outer peripheral side of the injector 30 by only inserting the injector 30 from the peripheral side of the end edges 40*c* and 40*d* of the pressing member 40 to the inner peripheral side. Further, the pressing member 40 can easily be arranged at a regular position only by fitting the second projection 43 to the second recess 37 in the process (1) and fitting the first projection 42 to the first recess 28 in the process (2).

In this way, the fuel supply apparatus 10 can easily and firmly be integrated to the cylinder head 2 and cost required for integration is reduced by facilitating the integration in this way.

In addition, according to the fuel supply apparatus 10, the second projection 43 of the pressing member 40 is fitted to the second recess 37 of the injector 30. In the fitted state, the inner peripheral face 43*a* of the second projection 43 is brought into contact with the inner wall face 37*a* constituting the changing portion of the second recess 37. Therefore, rotational force around the center axis O of the injector 30 for pressing the inner wall face 37*a* to the inner peripheral face 43*a* is canceled by the reaction force operated from the inner peripheral face 43*a* to the inner wall face 37*a*. By the canceling operation, rotation of the injector 30 to both sides in the peripheral direction is hampered. Therefore, the injector 30 can surely be positioned in the peripheral direction.

Further, according to the fuel supply apparatus 10, the portion of pressing the injector 30 by the pressing member 40 is set to the flange 36 which is not formed with the magnetic circuit. Therefore, the magnetic circuit is less disturbed by pressing from the pressing member 40, and an amount of lifting of the valve member 39 is reduced to thereby change an injection characteristic.

(Second Embodiment)

Figure 5:
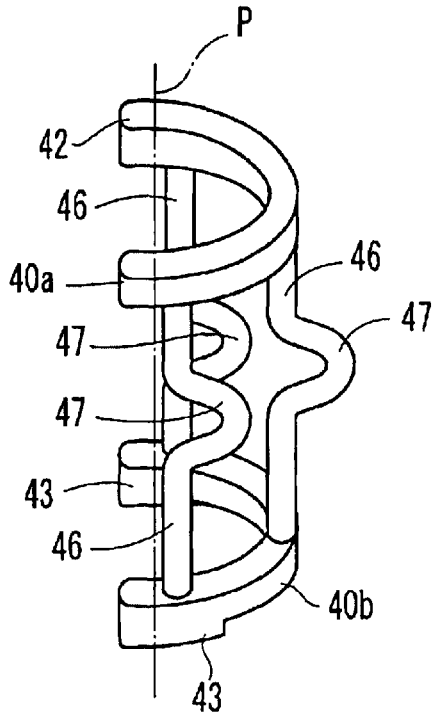
FIG. 5 is a perspective view showing an integrating part used as a pressing member of a fuel supply apparatus according to a second embodiment of the present invention.

In the second embodiment, an integrating part shown in FIG. 5 is used as the pressing member 40 in place of the integrating part shown in FIG. 3. According to the pressing member 40 of FIG. 5, only the end 40*a* arranged at the first projection 42 and the end 40*b* arranged at the second projection 43 are provided with cross-sectional faces in a U-like shape similar to those of the first embodiment. A plurality of rods 46 are extended between the ends 40*a* and 40*b*substantially in parallel with the center axis P. Thereby, the respective rods 46 are aligned at intervals from each other in the peripheral direction on the outer peripheral side of the injector 30 and the pressing member 40 as a whole surrounds a region of the outer periphery of the injector 30 less than one periphery in the peripheral direction.

A middle portion of each rod 46 in the axial direction is formed with a curved portion 47, a section of which is formed in an arch-like shape. The curved portion 47 of the embodiment is provided with a section in the arch-like shape bent smoothly to the outer side in the diametric direction of the pressing member 40. By the curved portion 47 of the each rod 46, the pressing member 40 is reduced in the rigidity in the axial direction and is facilitated to deform resiliently in the axial direction. That is, the curved portion 47 promotes the resilient deformation by reducing the coefficient of resiliency of the pressing member 40. Also the pressing member 40 of the second embodiment as a whole forms a resilient portion.

Even when the pressing member 40 according to the second embodiment is used, by the principle similar to that in the case of the first embodiment, the restricting force between the elements 20 and 2 can surely be ensured. The pressing force can sufficiently and surely be operated to the fuel supply port 22 and the flange 36 pinching the pressing member 40. Further, the coefficient of resiliency of the pressing member 40 according to the second embodiment is reduced by the plurality of curved portions 47. While the amount of changing the resilient reaction force relative to a change in the restricting force is reduced, the pressing force can be increased by increasing the amount of resilient deformation. Furthermore, since the pressing member 40 is constituted by the shape surrounding the region of the outer peripheral side of the injector 30 less than one periphery in the peripheral direction, the pressing member 40 is facilitated to arrange on the outer peripheral side of the injector 30.

(Third Embodiment)

Figure 6:
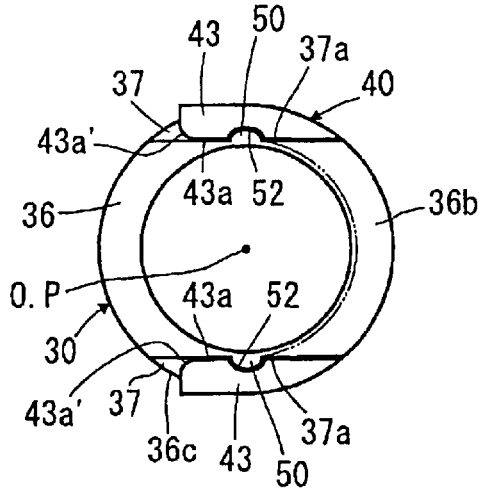
FIG. 6 is a schematic view showing an injector and a pressing member of a fuel supply apparatus according to a third embodiment of the invention.

In a fuel supply apparatus according to the third embodiment shown in FIG. 6, each second recess 37 of the flange 36 of the injector 30 is provided with a third projection 50 projected from the inner wall face 37*a* to the outer side in the diametric direction. Further, each second projection 43 projected in the axial direction of the pressing member 40 is provided with a third recess 52 opened to the inner peripheral face 43*a*. As shown in FIG. 6, each third projection 50 is fitted to the corresponding third recess 52.

According to the third embodiment, projecting directions of the second projection 43 and the third projection 50 differ from each other, and the second projection 43 and the third projection 50 are respectively fitted with the second recess 37 and the third recess 52. Therefore, detachment of the pressing member 40 can surely be prevented. Further, it is preferable to form an end edge 43*a*' of the inner peripheral face 43*a* of each second projection 43 connected to the end edge 40*c* or 40*d* of the pressing member 40 in an R shape (bent shape) as shown in FIG. 6. Thereby, when the injector 30 is inserted from the side of the end edge 40*c* or 40*d* of the pressing member 40 to the inner peripheral side for arranging the pressing member 40, inserting performance thereof is improved.

According to the above embodiments, the pressing member 40 is interposed between the fuel supply port 22 of the fuel transfer pipe 20 and the end 30*b* of the injector 30 on the side of the fuel injection port 22. However, so far as the pressing member 40 is interposed between the fuel transfer pipe 20 and the injector 30, a various arranging mode can be adopted therefor.

Further, according to the above embodiments, the pressing member 40 is constituted in a spring-like shape by providing the notch 41 or the curved portion 47 promoting the resilient deformation at the pressing member 40. In contrast thereto, the pressing member 40 may be provided with both of the notch and the curved portion, or the pressing member 40 may be formed of rubber or the like which is easy to deform resiliently and may not be provided with the notch and the curved portion.

Further, although according to the above second embodiment, the curved portion 47 of the pressing member 40 is formed in the arch-like shape in the section which is bent smoothly, the curved portion 47 of the pressing member 40 may be formed in an arch-like shape in its section which is bent to provide an apex. Furthermore, although according to the above second embodiment, the rod 46 of the pressing member 40 is locally formed with the curved portion 47, the curved portion 47 may be formed in a groove extending a cylindrical or a plate-like portion of the pressing member in a peripheral direction in an arch-like section.

Further, although according to the above embodiments, the inner wall faces 37*a* as the changing portions of the injector 30 are provided at the two locations in the peripheral direction, one or three or more of the changing portions may be provided. Furthermore, although according to the above embodiments, the changing portion is realized by the flat face changing the diameter from the center axis O of the injector 30 in the peripheral direction, the changing portion may be realized by a flat face changing the diameter from the center axis O of the injector in the diametric direction. Further, otherwise, the changing portion may be realized by a curved face of an elliptic curved face or the like for changing the diameter from the center axis of the injector in the peripheral direction.

Further, although according to the above embodiments, the restricting member is constituted by the support member 4 integrally provided with the cylinder head 2, and the bolt 26 as the screw member for fastening the fuel transfer pipe 20 to the support member 4. In contrast thereto, the restricting member may be fixed to a vehicle mounted with the cylinder head for restricting the cylinder head 2 and the fuel transfer pipe 20 from separating from each other by pressing or pulling the fuel transfer pipe 20 to the side of the cylinder head. In that case, the pressing force or pulling force of the restricting member is restricting force exerted to the fuel transfer pipe 20 and the cylinder head 2 indirectly via the vehicle.

Furthermore, according to the above embodiments, by fixing the fuel transfer pipe 20 and the cylinder head 2 to be unable to displace relative to each other by the restricting member comprising the support member 4 and the bolt 26, the elements 20 and 2 are restricted from separating from each other. In contrast thereto, the restricting member for restricting the separation from each other may be provided to be unable to displace relative to each other in a small range by resiliently coupling the fuel transfer pipe 20 and the cylinder head 2.

(Fourth Embodiment)

Figure 7:
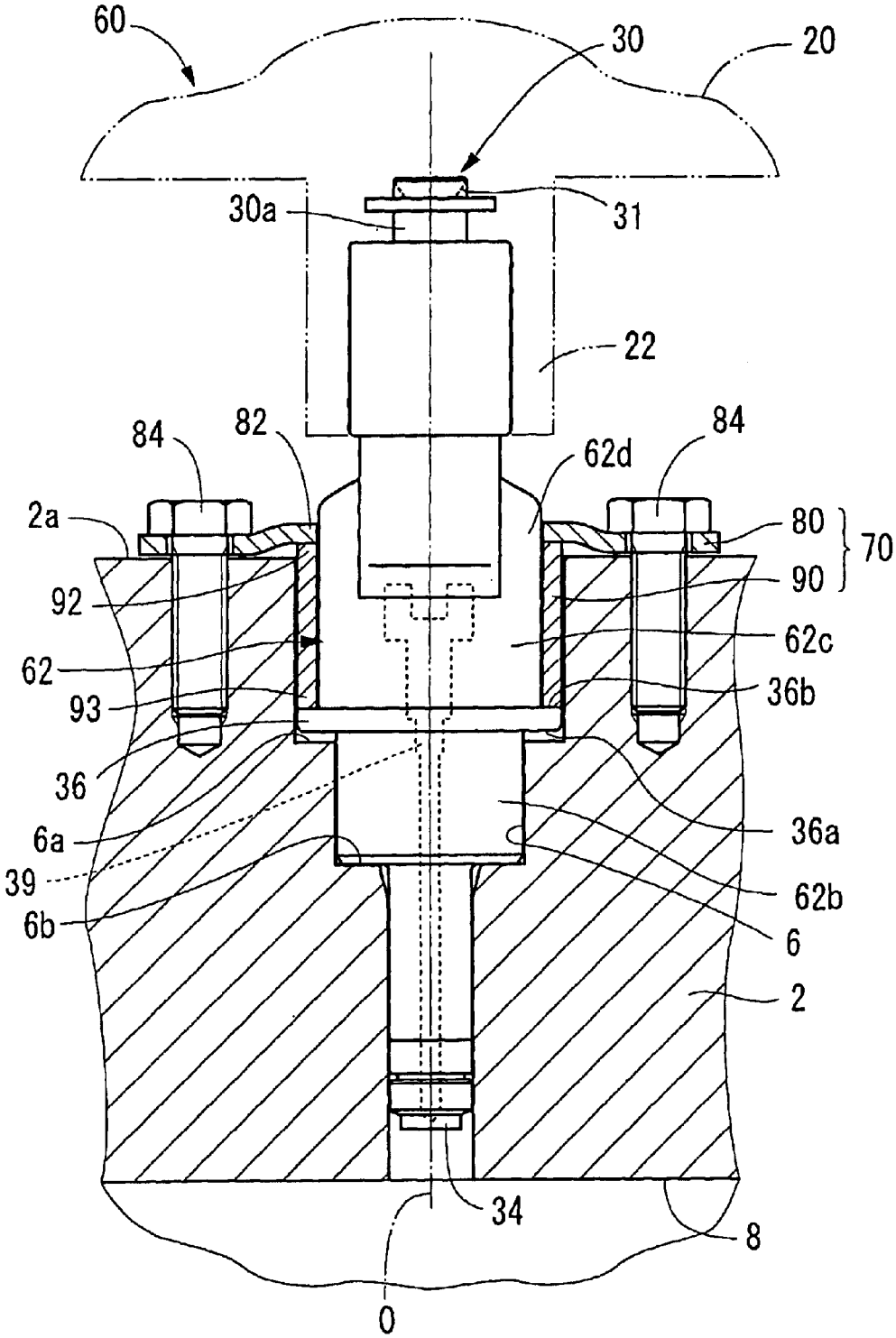
FIG. 7 is a partial sectional view showing a fuel supply apparatus according to a fourth embodiment of the present invention.

In a fuel supply apparatus 60 according to the fourth embodiment shown in FIG. 7, for lowering cost and reducing noise sound from the injector 30, an integrating member 70 is used in place of the pressing member 40 of the first embodiment. Further, according to the fuel supply apparatus 60, in order to promote reduced sound emitted from the injector 30, in a body 62 of the injector 30 containing the valve member 39, portions thereof inserted to the insertion port 6 are constituted by a main body of an end 62*b* in correspondence with the end 30*b* on the side of the fuel injection port according to the first embodiment and a portion 62*c* upstream from the flange 36.

Specifically, the integrating member 70 is constituted by a clamp member 80 as a first pressing portion and a shell member 90 as a second pressing portion.

The clamp member 80 is formed in, for example, a shape of a circular ring plate by a metal material such as stainless steel. The clamp member 80 is arranged to surround a portion 62*d* of the body 62 upstream from the portion 62*c* inserted into the insertion port 6 coaxially from the outer peripheral side. The clamp member 80 is fixed to the outer wall 2*a* of the cylinder head 2 by fastening bolts 84 penetrating a plurality of locations in the peripheral direction in a plate thickness direction. The rigidity of the clamp member 80 in a direction in parallel with the center axis O of the injector 30 is made to become lower than the rigidity thereof in a direction orthogonal to the center axis 0. Thereby, the inner peripheral edge 82 of the clamp member 80 can be deformed resiliently in the direction in parallel with the center axis O.

The shell member 90 is formed of a metal material such as stainless steel in a cylindrical shape. The shell member 90 is arranged to fill a space having a section in a shape of a circular ring formed between the outer peripheral wall of the portion 62*c* of a portion of the body 62 inserted into the insertion port 6 and the inner peripheral wall of the insertion port 6 over the entire region in the peripheral direction.

By this arrangement, the shell member 90 covers the portion 62*c* of the body 62 surrounded by the inner peripheral wall of the insertion port 6 over the entire region in the peripheral direction and brings the end 93 of the insertion port 6 in both ends thereof constituting a depth side into contact with the upstream side end face 36*b* of the flange 36. The rigidity of the shell member 90 in a direction in parallel with the center axis O of the injector 30 is made to become higher than the rigidity thereof in the direction orthogonal to the center axis O. Thereby, the end 92 of the both ends of the shell member 90 on the side opposing to the flange constituting the side of the opening portion of the insertion port 6 ca resiliently deform the inner peripheral edge 82 of the clamp member 80 engaged therewith.

In the fuel supply apparatus 60, the clamp member 80 presses the inner peripheral edge 82 to the end 92 of the shell member 90 in accordance with axial force of the fastening bolt 84 fixing the clamp member 80 to the cylinder head 2. Thereby, the inner peripheral edge 82 of the clamp member 80 is resiliently deformed to the side of the fuel flow inlet 31 of the injector 30, that is, the side of the fuel transfer pipe 20, and presses the end 92 of the shell member 90 by the resilient reaction force. The shell member 90 presses the flange 36 of the injector 30 to the depth side of the insertion port 6 by the press force received from the clamp member 80. The end 62*b* of the body 62 on the side of the fuel injection port is pressed to the stepped face 6*b* on the depth side in the two stepped faces 6*a* and 6*b* directed to the opening portion side of the insertion port 6 to thereby integrate the injector 30 to the cylinder head 2.

Further, according to the embodiment, the fuel transfer pipe 20 is integrated to the cylinder head 20 by a support member and a belt, for example, similar to those of the first embodiment.

According to the fuel supply apparatus 60 of this embodiment, the flange 36 of the injector 30 is pressed by utilizing the resilient deformation of the clamp member 80. Therefore, the clamp member 80 needs not to be particularly highly rigid. Therefore, at least the clamp member 80 of the integrating member 70 can be formed by an inexpensive material, and therefore cost required for integration is reduced. Further, according to the fuel supply apparatus 60, at least the shell member 90 of the integrating member 70 is arranged to insert into the insertion port 6. Therefore, a space necessary for integration is reduced.

Furthermore, according to the fuel supply apparatus 60, the clamp member 80 in the shape of the circular ring plate and the shell member 90 in the cylindrical shape can be arranged uniformly around the center axis O of the injector 30. Therefore, a space for arranging the integrating member 70 comprising the members 80 and 90 can be restrained from increasing from the center axis O of the injector 30 in the diametric direction. Therefore, the integrating member 70 can be arranged in various shape of the cylinder heads 2. In addition thereto, since the injector 30 is pressed by the clamp member 80 in the shape of the circular ring and the shell member 90 in the cylindrical shape, a state of holding the injector 30 is not constituted by so-called one side support and becomes solid.

Further, according to the fuel supply apparatus 60, the portion 62*c* of the body 62 of the injector 30 is covered over the entire region in the peripheral direction by the shell member 90, further by the insertion port 6. Thereby, operating sound accompanied by reciprocating the valve member 39 can be prevented from emitting from the body 62 of the injector 30 to constitute noise.

Figure 8:
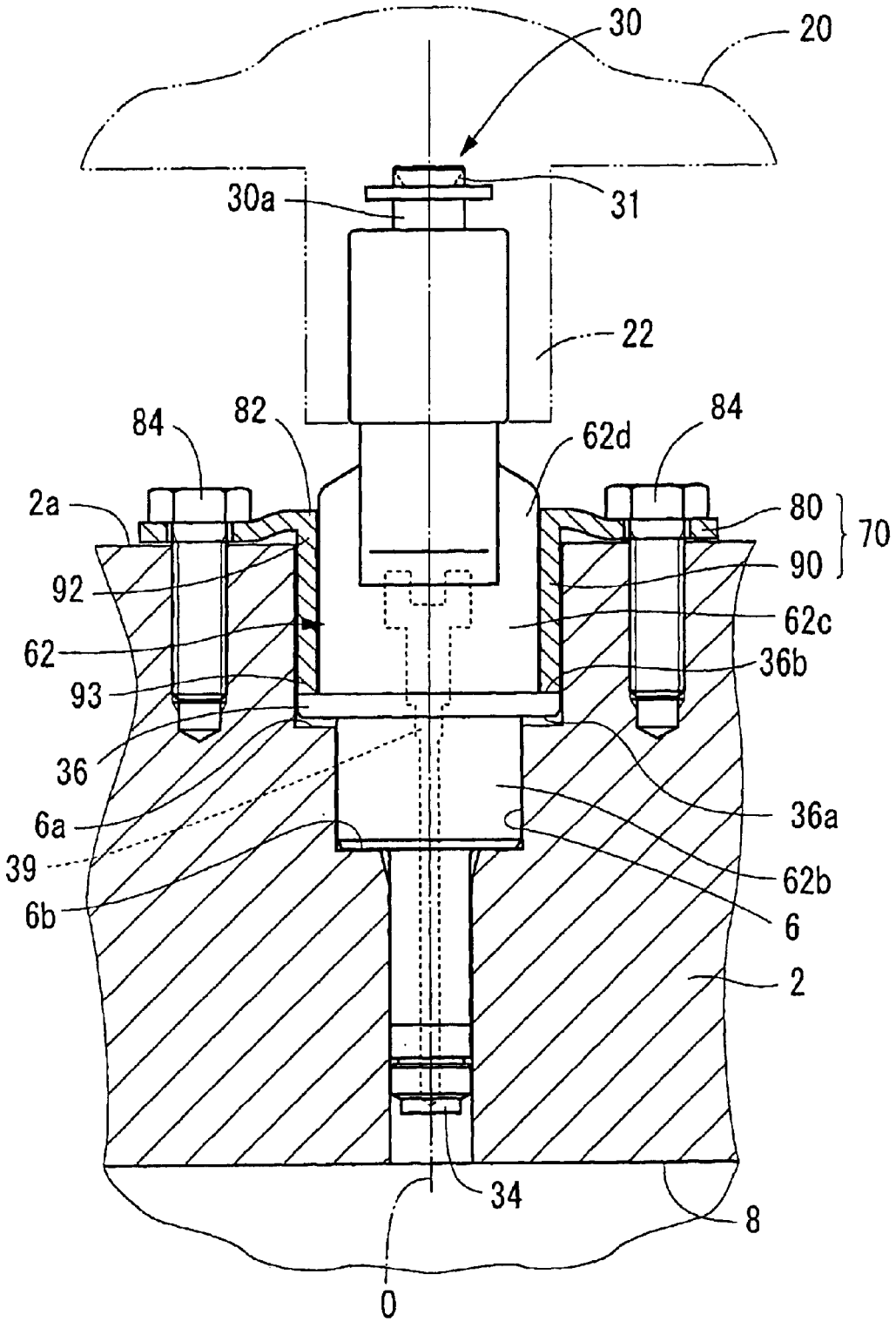
FIG. 8 is a partial sectional view showing a modified example of the fuel supply apparatus according to the fourth embodiment of the present invention.

Further, as shown in a modified example of FIG. 8, the clamp member 80 as the first pressing portion and the shell member 90 as the second pressing portion may integrally be formed by a single member. Further, respective shapes of the clamp member 80 as the first pressing member and the shell member 90 as the second pressing member may be shapes interrupted in the peripheral direction around the center axis O of the injector 30 or shapes extended in the peripheral direction around the center axis O less than one periphery other than the shape of the ring plate and the cylindrical shape. The shell member 90 having the interrupted shape or the extended shape less than one periphery can restrain noise by emitting operating sound of the valve member 39 by covering a portion of the injector 30 inserted into the inserting potion 6 of the body 62 in the peripheral direction.

Further, in accordance with the shape adopted for the shell member 90 constituting the second pressing portion, the flange 36 as the projection can be constituted by a shape of a circular ring plate, a shape interrupted in the peripheral direction around the center axis O, or a shape extended in the peripheral direction around the center axis O less than one periphery.

(Fifth Embodiment)

Figure 9:
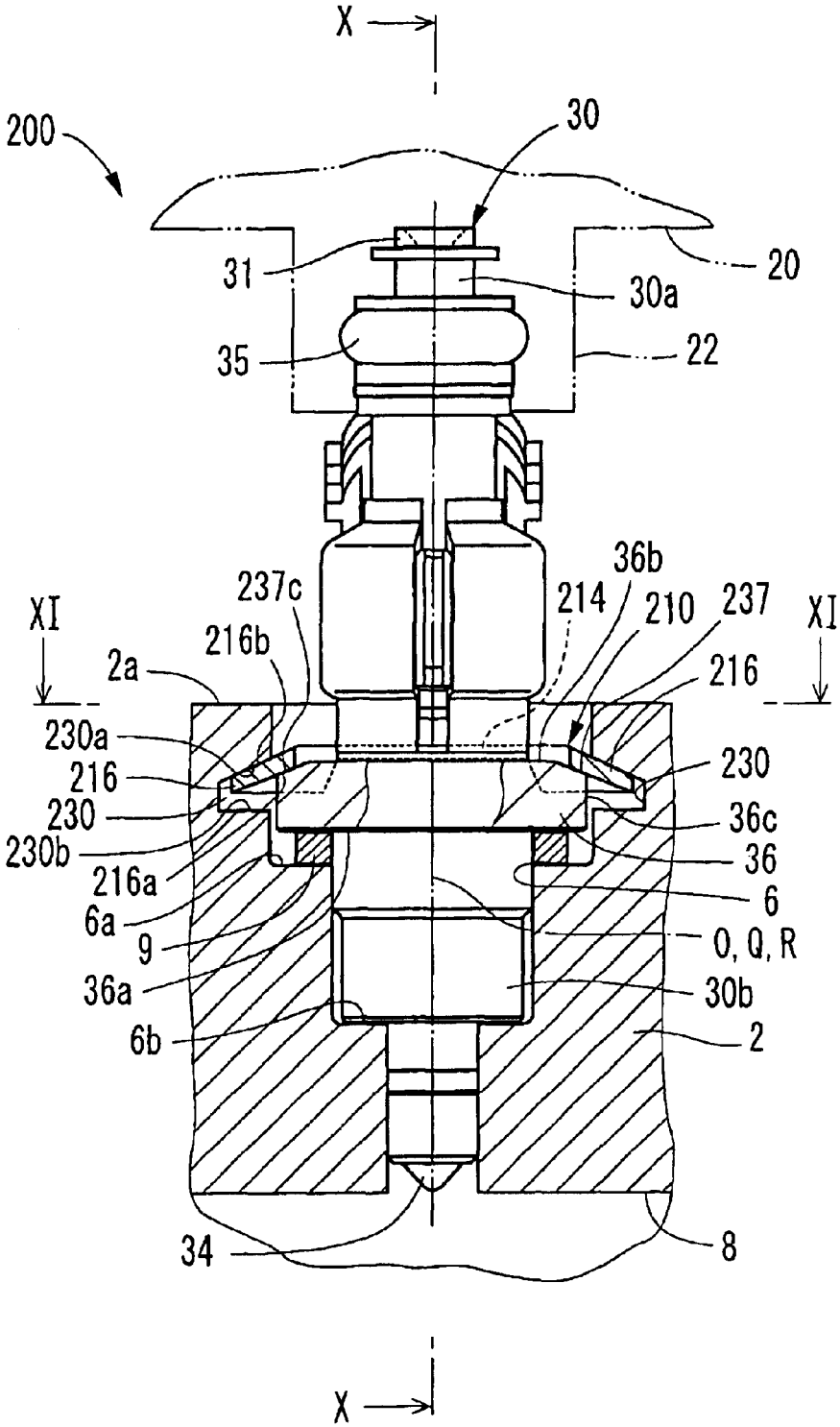
FIG. 9 is a partial sectional view showing a fuel supply apparatus according to a fifth embodiment of the present invention.
Figure 10:
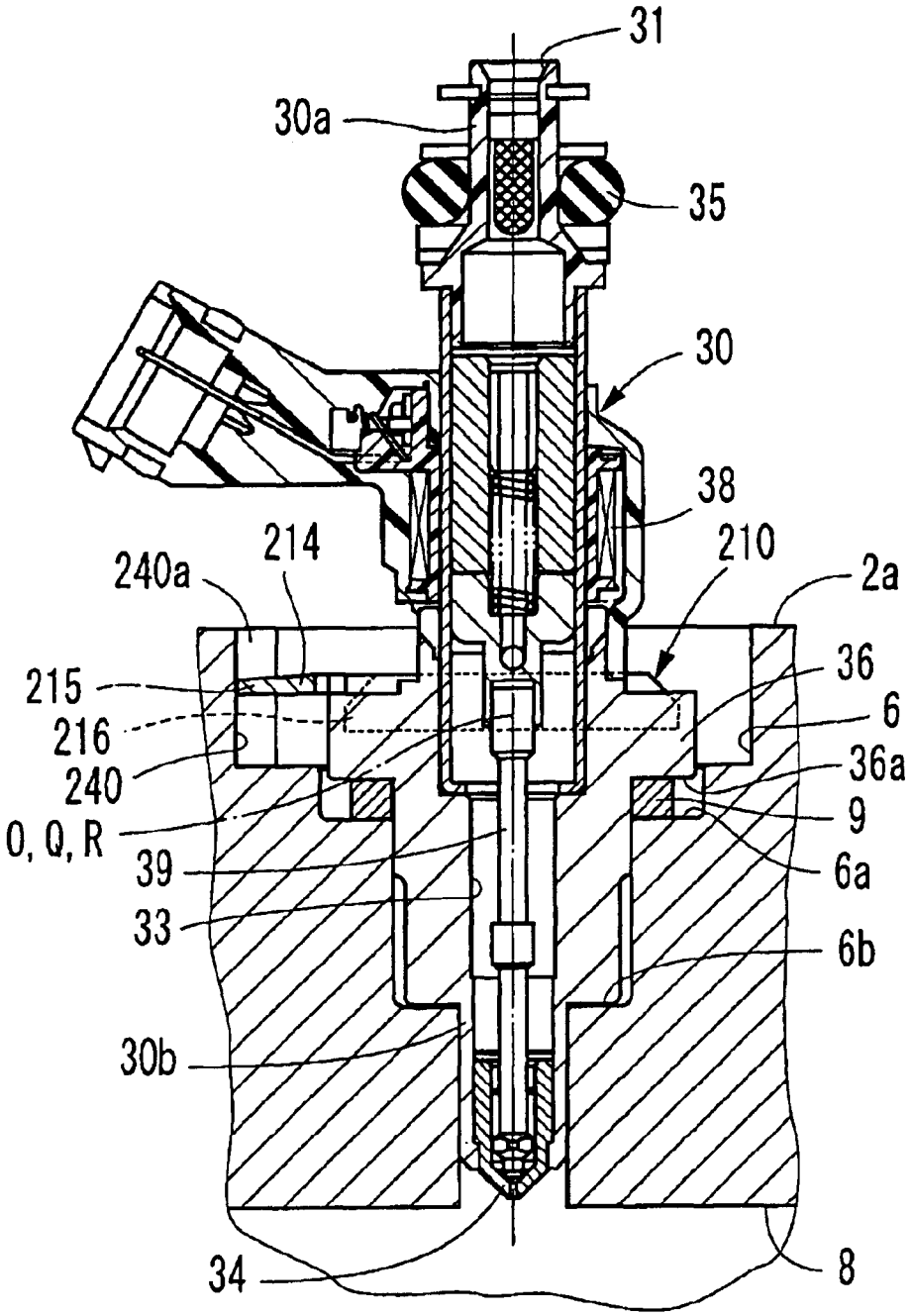
FIG. 10 is a sectional view taken along a line X—X of FIG. 9.

According to a fuel supply apparatus 200 of the fifth embodiment shown in FIGS. 9 and 10, with an object of lower cost, an integrating member 210 is used in place of the pressing member 40 of the first embodiment, and a locking groove 230 as a locking portion for locking the integrating member 210 is formed by the inner wall of the insertion port 6.

Figure 11:
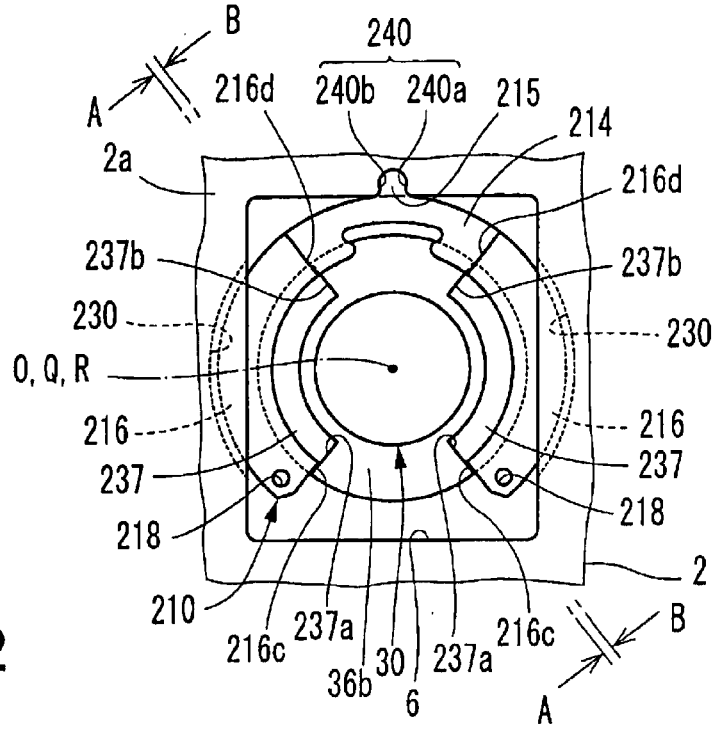
FIG. 11 is a sectional view taken along a line XI—XI of FIG. 9.

As shown in FIG. 11, a portion of the insertion port 6 on the side of the opening portion of the stepped face 6*a* (FIG. 10) is provided with a cross-sectional face in a rectangular shape and formed with locking grooves 230 at two locations in the peripheral directions. The two locking grooves 230 face each other by interposing a center axis Q of the insertion port 6 coinciding with the center axis O of the injector 30 and are respectively extended around the center axis Q by a length of about a quarter periphery.

As shown in FIG. 9, the inner wall face 230*a* of inner wall faces 230*a* and 230*b* of the locking groove 230 facing each other in the axial direction of the insertion port 6 on the side of the opening portion of the insertion port 6 is a taper face, a diameter of which is increased toward the depth side of the insertion portion 6. The taper face 230*a* constitutes the second, taper face.

As shown in FIG. 10 and FIG. 11, a portion closer to the opening portion than the stepped face 6*a* of the insertion port 6 is further formed with a fitting groove 240 opening to the outer wall 2*a* of the cylinder head 2. The fitting groove 240 is extended in parallel with the center axis Q at a portion constituting an interval of the two locking grooves 230 in the peripheral direction of the insertion port 6.

Figure 12:
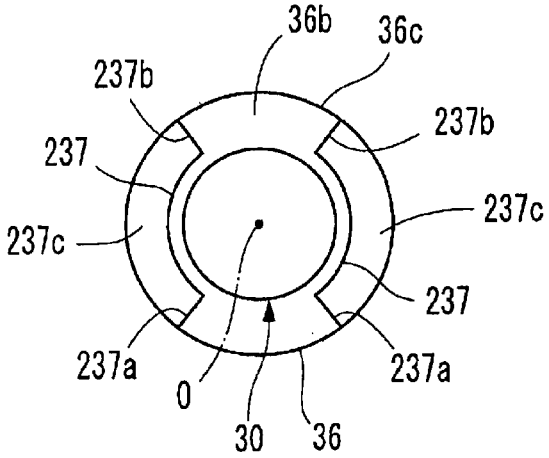
FIG. 12 is a schematic view showing a flange used in the fuel supply apparatus shown in FIG. 9.

As shown in FIG. 9, a portion of the injector 30 downstream from the flange 36 is inserted to the side deeper than the stepped face 6*a* of the insertion port 6 and the flange 36 and a portion thereof upstream from the flange 36 is inserted to the side closer to the opening portion than the stepped face 6*a* of the insertion port 6. As shown in FIG. 11 and FIG. 12, the flange 36 is formed with recesses 237 opened to the upstream side end face 36*b* and the side faces 36*c* at two locations in the peripheral direction. The two recesses 237 face each other with the center axis O interposed and respectively extended around the center axis O by a length of about a quarter periphery. Inner wall faces 237*a* and 237*b* of the recess 237 are flat faces expanded in the diametric direction and the axial direction of the flange 36.

As shown in FIG. 9 and FIG. 12, the inner wall face 237*c* of the recess 237 connecting an interval of the upstream side end face 36*b* and the side face 36*c* and the interval of the inner wall face 237*a* and the inner wall face 237*b* is a taper face the diameter of which is increased toward the depth side of the insertion port 6. The angle of inclination of an acute angle side of the taper face 237*c* relative to the center axes O and Q is larger than the angle of inclination on the acute side of the taper face 230*a* relative to the center axes O and Q.

Figure 13:
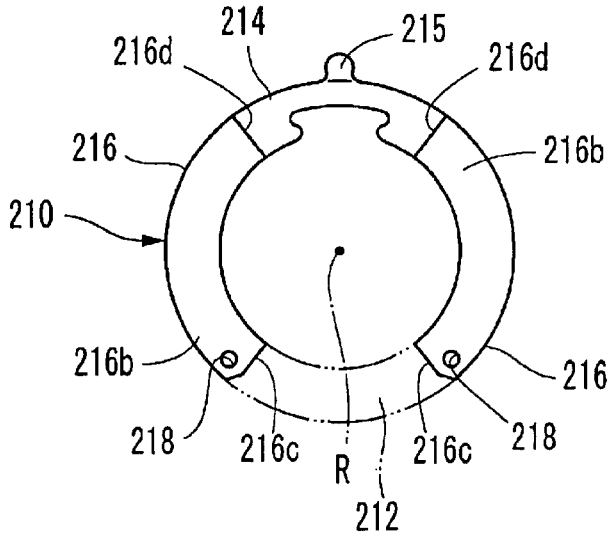
FIG. 13 is a plan view showing an integrating member used in the fuel supply apparatus shown in FIG. 9.

The integrating member 210 shown in FIG. 13 is formed of a resiliently deformable plate material such as SK material and is formed in a snap ring shape of a C-like shape or a horseshoe shape having an opening portion 212 at one location on the periphery. As shown in FIG. 9 and FIG. 10, the integrating member 210 is arranged at inside of the insertion port 6 to generate a recovery force in the diametric direction by resilient deformation accompanied by a change in the diameter. As shown in FIG. 11, the integrating member 210 surrounds the outer peripheral side of the injector 30 coaxially on the upstream side of the flange 36, and a gap between the integrating member 210 and the injector 30 is produced.

As shown in FIG. 11 and FIG. 13, the integrating member 210 is formed with a base portion 214 at a portion thereof opposed to the opening portion 212 with a center axis R interposed and formed with two arm portions 216 on both sides in the peripheral direction of the base portion 214.

The base portion 214 is provided with a fitting projection 215 projecting to the outer peripheral side opposed to the opening portion 212. The fitting projection 215 is fitted to the fitting groove 240 of the insertion port 6 and interposed by inner wall faces 240*a* and 240*b* of the fitting groove 240 of the insertion port 6 facing each other in the peripheral direction. Thereby, the integrating member 210 is positioned to the cylinder head 2 to be unable to rotate relative to each other in the peripheral direction. The fitting projection 215 constitutes a first positioning portion.

The two arm portions 216 face each other with the center axis R interposed and are respectively extended from both ends of the base portion 214 around the center axis R by a length of about a quarter periphery. As shown in FIG. 9, two faces 216*a* and 216*b* of the arm portion 216 in a plate thickness direction along the center axis R are taper faces, the diameters of which are increased toward the depth side of the insertion port 6. According to the taper face 216*a* on the side of the flange 36, the angle of inclination on the acute angle side relative to the center axes O, Q, R is set to be substantially the same as that of the taper face 237*c* of the flange 36, and the outer peripheral portion thereof is brought into contact with an inner peripheral portion of the taper face 230*a* opposed thereto.

Figure 14A:
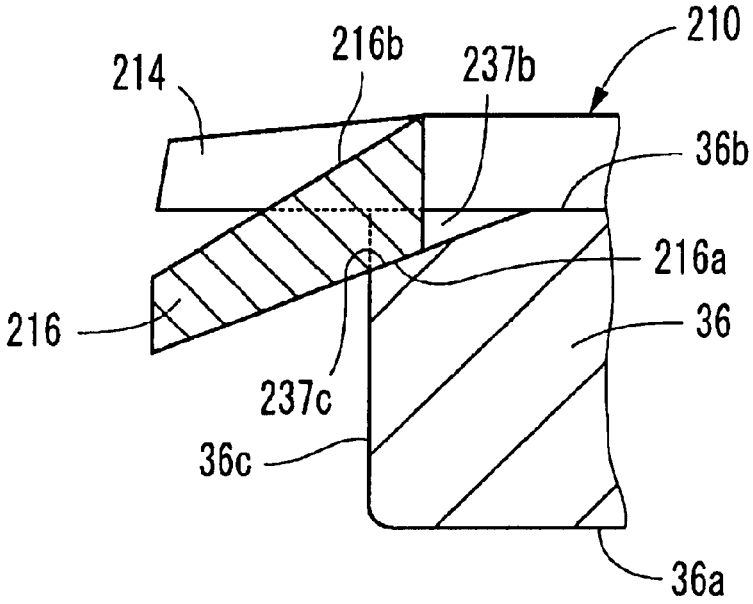
FIGS. 14A and 14B are sectional views taken along a line XIVA—XIVA of FIG. 11 and a line XIVB—XIVB of FIG. 11.
Figure 14B:
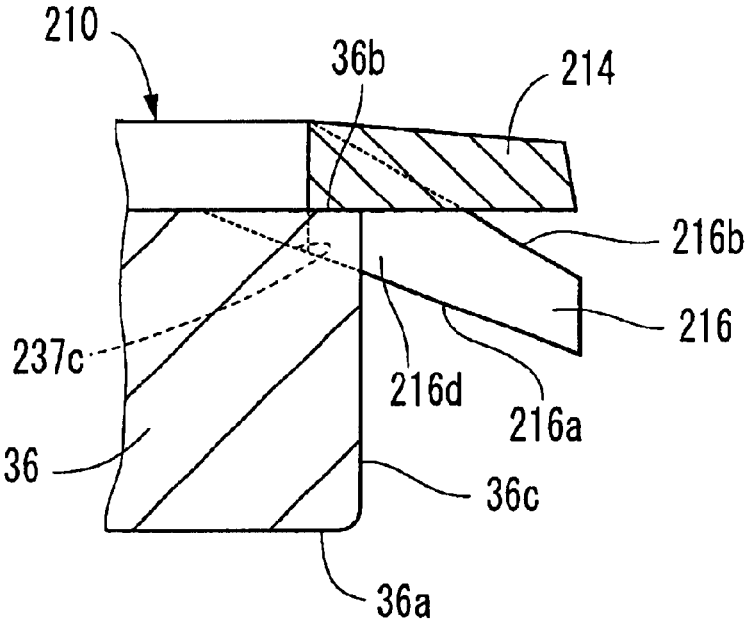

According to the taper face 216*b*on the side opposed to the flange, the angle of inclination on the acute angle side relative to the center axes O, Q, R is set to be substantially the same as that of the taper face 230*a* of the locking groove 230, and the outer peripheral portion thereof is brought into contact with the inner peripheral portion of the taper face 230*a* opposed thereto. The arm portion 216 is interposed between the taper faces 230*a* and 237*a* in the direction inclined to the center axes O, Q, R. Further, the inner peripheral side is thicker than the outer peripheral side in the plate thickness of the arm portion 216 as shown in FIG. 14 by setting the above angle of inclination. The taper face 216*b* constitutes the first taper face.

As shown in FIG. 11 and FIG. 13, at the end of each arm portion 216 on the side of interposing the opening portion 212, an inserting hole 218 is penetrated in parallel with the center axis R. End faces 216*c* of the respective arm portions 216 on the sides of interposing the opening portion 212 are flat faces expanded in the diametric direction and the axial direction of the integrating member 210 and are respectively brought into contact with the inner wall faces 217*a* of the recesses 237 opposing each other. End faces 216*d* of the respective arm portions 216 on the sides of interposing the base portion 214 are flat faces expanded in the diametric direction and the axial direction of the integrating member 210 and are respectively brought into contact with inner wall faces 217*b*of the recesses 217 opposing each other.

As shown in FIG. 11 and FIG. 14, the arm portion 216 is fitted to the recess 237 to position not only the flange 36 but also the injector 30 to be unable to rotate relative to each other in the peripheral direction. The arm portion 216 constitutes a second positioning portion.

The fuel supply apparatus 200 is integrated to the cylinder head 2 in the following processes.

(I) The integrating member 210 is temporarily arranged to the outer peripheral side of the injector 30. At this occasion, the arranging operation is facilitated by resiliently deforming the integrating member 210 such that the opening portion 212 is expanded by using a tool inserted into the insertion hole 218 and inserting the injector 30 from the expanded opening portion 212 to the inner peripheral side of the integrating member 210.

Figure 15:
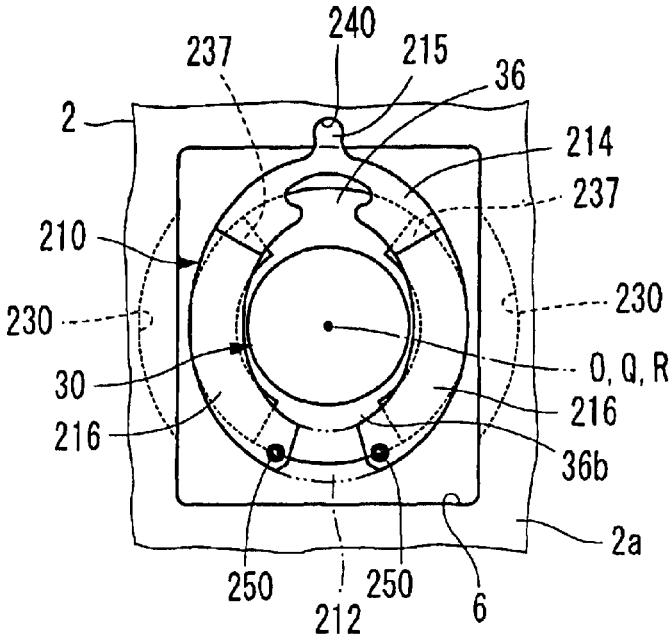
FIG. 15 is a sectional view for explaining a method of integrating the fuel supply apparatus according to the fifth embodiment of the present invention.
Figure 16:
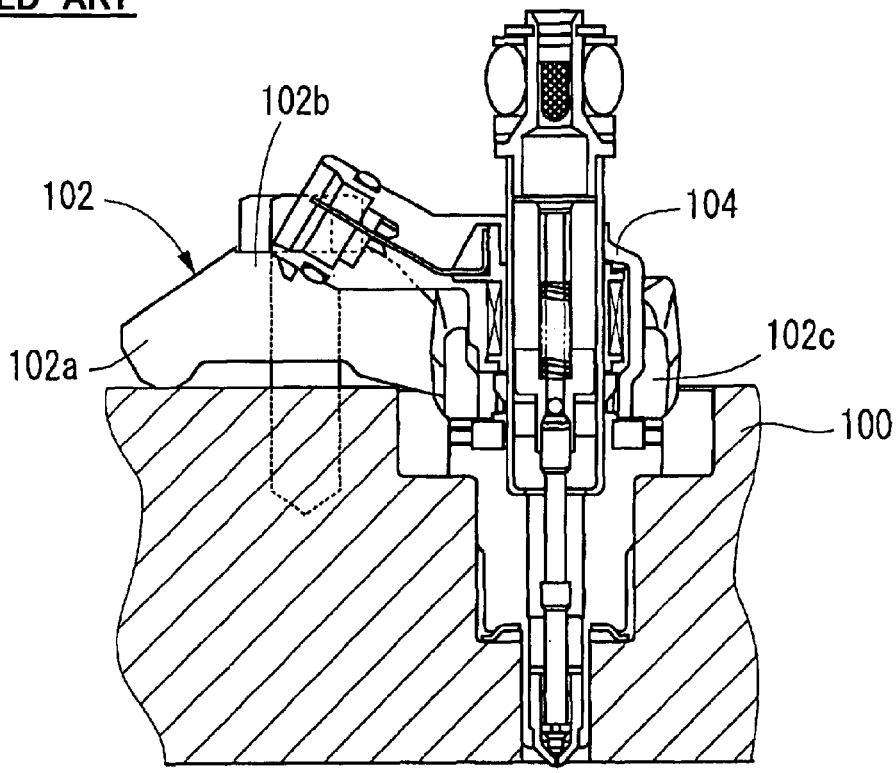
FIG. 16 RELATED ART
FIG. 16 is a sectional view showing a fuel supply apparatus according to a related art.

(II) A predetermined portion of the injector 30 is arranged at inside of the insertion port 6 along with the integrating member 210. At this occasion, first, as shown in FIG. 15, the integrating member 210 is resiliently deformed such that the opening portion 212 is contracted by using a tool 250 inserted into the inserting hole 218 to thereby reduce the diameter of the integrating member 210 into a size capable of inserting into the insertion port 6. Next, the integrating member 210 and the injector 30 are inserted into the insertion port 6 while maintaining the diameter of the integrating member 210 and slidingly fitting the fitting projection 215 into the fitting groove 240.

After the downstream side end face 36*a* of the flange 36 is brought into contact with the stepped face 6*a* of the insertion port 6 via the gasket 9, the integrating member 210 is recovered to the original shape while pressing each taper face 216*a*of the integrating member 210 to each taper face 237*c* of the flange 36 by using the tool 250. Simultaneously, the outer peripheral portion of each arm portion 216 of the integrating member 210 is inserted into each locking groove 230 of the insertion port 6 while bringing each taper face 216*b* of the integrating member 210 into sliding contact with each taper face 230*a* of the insertion port 6. After each arm portion 216 is inserted into each locking groove 230 to some degree, the tool 250 is detached from the inserting hole 218. Then, each taper face 216*b* presses each taper face 230*a* by a recovery force of the integrating member 210 in the diametric direction, and therefore each arm portion 216 is locked by each locking groove 230.

In the locking state, the taper face 216*b* receives a reaction force against pressing from the taper face 230*a* and a component of the reaction force in the axial direction directed to the depth side of the insertion port 6 is transmitted to the flange 36 via an interface at which the paper faces 216*a* and 237*c* are brought into contact with each other. By the transmitted force, the flange 36 is pressed to the depth side of the insertion port 6 and pressed to the stepped face 6*a* via the gasket 9, and therefore the injector 30 is fixedly integrated to the cylinder head 2.

Further, thereafter, by using, for example, a support member and a bolt similar to those of the first embodiment, the fuel transfer pipes 20 is integrated to the cylinder head 2.

According to the fuel supply apparatus 200, by a simple method of locking the integrating member 210 temporarily arranged on the outer peripheral side of the injector 30 by the locking groove 230, the injector 30 can be integrated to the cylinder head 2. Particularly, the integrating member 210 in the shape of a snap ring can realize resilient deformation accompanied by a change in the diameter. Therefore, even after contracting the integrating member 210 to insert into the insertion port 6 which is smaller than the integrating member 210, the integrating member 210 can be locked by the locking groove 230 only by recovering the integrating member 210.

Further, according to the fuel supply apparatus 200, the locking groove 230 for locking the integrating member 210 is formed by the inner wall of the insertion port 6. Therefore, a part for locking the integrating member 210, further, a bolt or the like for fastening the part to the cylinder head 2 are dispensed with. In the fuel supply apparatus 200 capable of integrating easily in this way and capable of reducing a number of parts, the integrating cost is reduced.

Further, according to the fuel supply apparatus 200, a force of pressing the injector 30 is ensured by utilizing the reaction force produced by pressing the locking groove 230 by the integrating member 210. Particularly, the integrating member 210 in the snap ring shape can surely generate the recovery force in the diametric direction for pressing the locking groove 230 at least at the arm portion 216. Therefore, the reaction force received by the integrating member 210 from the locking groove 230 can be increased.

Further, since the integrating member 210 presses the taper face 230*a* of the locking groove 230 in the diametric direction by the taper face 216*b*, the component of the reaction force in the axial direction against the pressing force can surely be exerted. As described above, large force of pressing the injector 30 can be ensured. Therefore, solid performance of integration and sealing performance of the gasket 9 are promoted.

Furthermore, according to the fuel supply apparatus 200, in addition to the fact that the fitting projection 215 is fitted to the fitting groove 240, friction force between the taper faces 216*b* and 230*a* is increased by the reaction force received by the integrating member 210 from the locking groove 230. Therefore, an effect of positioning the integrating member 210 in the peripheral direction relative to the cylinder head 2 is enhanced.

Further, according to the fuel supply apparatus 200, in addition to the fact that each arm portion 216 is fitted to each recess 237, friction force between the taper faces 216*a* and 237*c* is increased by the reaction force received by the integrating member 210 from the locking groove 230. Therefore, an effect of positioning the injector 30 in the peripheral direction relative to the integrating member 210 is also enhanced. As described above, both of the integrating member 210 and the injector 30 are surely positioned relative to the cylinder head 2. Therefore, the force of pressing the injector 30 is stably exerted and solid performance of integration is increased.

Furthermore, according to the fuel supply apparatus 200, the integrating member 210 as a whole is arranged at inside of the insertion port 6. Therefore, a space necessary for integration is reduced.

Further, although according to the above-described fifth embodiment, the integrating member 210 in the snap ring shape having the opening portion 212 at one location on the periphery is used, an integrating member can be adopted so far as the integrating member is locked by a locking portion and can press an injector to a depth side of an insertion port by a reaction force received from the locking portion.

What is claimed is:

1. A fuel supply apparatus for an internal combustion engine having a cylinder head, the apparatus comprising:

a fuel injection device for injecting fuel into a cylinder of an internal combustion engine, the injection device having an axial end on a side of a fuel injection port thereof being inserted into the cylinder head of the internal combustion engine;

a fuel transfer pipe inserted with another axial end of the fuel injection device on a side of a fuel flow inlet thereof for transferring the fuel to the fuel injection device;

restricting means for restricting the fuel transfer pipe and the cylinder head from being separated from each other; and a pressing member interposed between the fuel transfer pipe and the fuel injection device to thereby receive a restricting force of the restricting means for pressing the fuel transfer pipe to a side opposing the cylinder head and pressing the fuel injection device to a side of the cylinder head by a reaction force against the restricting force.

2. The fuel supply apparatus according to claim 1, wherein the pressing member is held sandwiched by a fuel supply port of the fuel transfer pipe in which the axial end on the side of the fuel flow inlet is inserted and the axial end on the side of the fuel injection port.

3. The fuel supply apparatus according to claim 2, wherein one and the other of the pressing member and the fuel supply port have a first projection and a first recess fitted with the first projection, respectively.

4. The fuel supply apparatus according to claim 3, wherein one and the other of the pressing member and the fuel injection port have a second projection and a second recess fitted with the second projection, respectively.

5. The fuel supply apparatus according to claim 4, wherein one and the other of the second projection and the second recess have a third projection a projecting direction of which differs from a projecting direction of the second projection and a third recess fitted with the third projection, respectively.

6. The fuel supply apparatus according to claim 1, wherein the pressing member is formed in a shape of surrounding a part of an outer peripheral side region of the fuel injection device less than an entire periphery but no less than a half periphery in a peripheral direction.

7. The fuel supply apparatus according to claim 1, wherein the pressing member is formed at least partially with a resilient portion for producing the reaction by a resilient deformation.

8. The fuel supply apparatus according to claim 7, wherein the pressing member includes as the resilient portion a plurality of notches provided in a circumferential direction and arranged in an axial direction of the fuel injection device for promoting the resilient deformation.

9. The fuel supply apparatus according to claim 7, wherein the pressing member includes as the resilient portion a plurality of rods extending in an axial direction of the fuel injection device, and each rod includes a curved portion curved in a diameter direction of the fuel injection device in an arch-like shape for promoting the resilient deformation.

10. The fuel supply apparatus according to claim 1, wherein the fuel injection device includes a changing portion a diameter from a center axis of which is changed at an outer peripheral side thereof, and the pressing member is brought into contact with the changing portion at an interposed portion on a side of the fuel injection device.

11. The fuel supply apparatus according to claim 1, wherein the pressing member presses a portion of the fuel injection device at which a magnetic circuit for driving a valve member is not formed.

12. The fuel supply apparatus according to claim 1, wherein the restricting means includes a support member provided to extend from the cylinder head to a side of the fuel transfer pipe and a screw member for fastening the fuel transfer pipe to the support member.

13. The fuel supply apparatus according to claim 1, wherein the fuel injection device has a flange formed with a pair of flat parallel outer wall surfaces, the pressing member has a part formed with a pair of flat parallel inner wall surfaces, and the outer wall surfaces and the inner wall surfaces are fit each other thereby to restrict rotation between the fuel injection device and the pressing member.

14. A fuel supply apparatus for an internal combustion engine having a cylinder head, the apparatus comprising:

a fuel injection device inserted into an insertion port provided in the cylinder head for injecting fuel into a cylinder of the internal combustion engine; and a resilient integrating member for integrating the fuel injection device to the cylinder head;

wherein the integrating member includes a first pressing portion and a second pressing portion, the first pressing portion is fixed to the cylinder head for pressing the second pressing portion by being deformed resiliently, and the second pressing portion is arranged between an insertion portion of the fuel injection device inserted in the insertion port and the insertion portion for pressing a projection projected from the insertion portion to an outer side in a diametric direction to a depth side of the insertion port by receiving a pressing force of the first pressing portion.

15. The fuel supply apparatus according to claim 14, wherein the first pressing portion is arranged on a side of the second pressing portion opposing the projection.

16. The fuel supply apparatus according to claim 15, wherein the first pressing portion is formed in a shape of a ring plate surrounding an outer peripheral side of the fuel injection device, the ring plate has a resilient raised part at a diametrically inner side thereof and has a flat part at a diametrically outer side to be fixed to the cylinder head, the second pressing portion is formed in a shape of a cylinder filling an interval between the insertion portion and the insertion port over an entire region in a peripheral direction, and the end on the side opposing the projection is pressed in an axial direction of the fuel injection device by the raised part of the first pressing portion.

17. The fuel supply apparatus according to claim 14, wherein the fuel injection device includes a valve member for opening and closing a fuel injection port by being reciprocated and a body for containing the valve member and the insertion portion is at least a portion of the body.

18. A fuel supply apparatus for an internal combustion engine having a cylinder head, the apparatus comprising:

a fuel injection device inserted into an insertion port provided in the cylinder head of the internal combustion engine for injecting fuel into a cylinder of the internal combustion engine; and a resilient integrating member for integrating the fuel injection device to the cylinder head;

wherein the insertion port forms a locking portion by an inner wall thereof and the integrating member is locked by the locking portion to receive a reaction force and presses the fuel injection device to a depth side of the insertion port by the reaction force.

19. The fuel supply apparatus according to claim 18, wherein the integrating member is arranged in the insertion port.

20. The fuel supply apparatus according to claim 18, wherein the integrating member is formed to be able to deform resiliently for pressing the locking portion by a recovery force.

21. The fuel supply apparatus according to claim 20, wherein the integrating member includes a first taper face a diameter of which is increased toward the depth side of the insertion port and which is brought into contact with the locking portion from the depth side of the insertion port and is locked by the locking portion by pressing the locking portion in a direction of the diameter by the first taper face.

22. The fuel supply apparatus according to claim 20, wherein the locking portion includes a second taper face a diameter of which is increased toward the depth side of the insertion port and which is brought into contact with the integrating member from the depth side of the insertion port and the integrating member is locked by the locking member by pressing the second taper face in a direction of the diameter.

23. The fuel supply apparatus according to claim 21, wherein the integrating member is formed in a shape of a snap ring having an opening portion at one location on a periphery thereof for generating the recovery force in the diametric direction by a resilient deformation accompanied by a change in the diameter.

24. The fuel supply apparatus according to claim 18, wherein the integrating member includes a first positioning portion for positioning the integrating member relative to the cylinder head by being fitted to the insertion port.

25. The fuel supply apparatus according to claim 24, wherein the integrating member includes a second positioning portion for positioning the fuel injection device relative to the integrating member by being fitted to a portion of the fuel injection device inserted into the insertion port.

26. The fuel supply apparatus according to claim 18, wherein the integrating member is ring-shaped to surround the fuel injection device peripherally, the integrating member has an outer diameter larger than a normal diameter of the insertion port, and the insertion port has a lock groove in a middle of an axial length thereof to receive the integrating member therein in a pressed manner, the lock groove having a diameter larger than the normal diameter of the insertion port.

27. The fuel supply apparatus according to claim 26, wherein the integrating member is in a plate form, and the lock groove has a tapered wall so that the diameter of the lock groove increases as the wall extends in a direction in which the fuel injection device is inserted in the insertion port.

* * * * *